US005278344A

United States Patent [19]

Gosling et al.

[11] Patent Number: 5,278,344

[45] Date of Patent: Jan. 11, 1994

[54] INTEGRATED CATALYTIC REFORMING AND HYDRODEALKYLATION PROCESS FOR MAXIMUM RECOVERY OF BENZENE

[75] Inventors: Christopher D. Gosling, Roselle, Ill.; John D. Swift, Hindhead Surrey, England

[73] Assignee: UOP, Des Plaines, Ill.

[21] Appl. No.: 990,484

[22] Filed: Dec. 14, 1992

[51] Int. Cl.[5] ..... C07C 1/00; C07C 15/00; C07C 7/00; C10G 57/00

[52] U.S. Cl. ..... 585/322; 585/319; 585/407; 585/483; 585/804; 585/831; 585/488; 208/62; 208/102; 62/11; 62/17; 62/18; 62/23

[58] Field of Search ..... 585/319, 322, 407, 483, 585/804, 831, 488; 208/62, 102; 62/11, 17, 18, 23

[56] References Cited

U.S. PATENT DOCUMENTS

| | | | |
|---|---|---|---|
| 3,197,523 | 7/1965 | Michalko et al. | 260/672 |
| 3,664,949 | 5/1972 | Petersen et al. | 208/65 |
| 3,864,241 | 2/1975 | Rausch | 208/139 |
| 4,053,388 | 10/1977 | Bailey | 585/483 |
| 4,115,247 | 9/1978 | Lehman et al. | 585/483 |
| 4,157,355 | 6/1979 | Addison | 585/321 |
| 4,247,729 | 1/1981 | Takahashi et al. | 585/483 |

*Primary Examiner*—Anthony McFarlane
*Assistant Examiner*—Nhat D. Phan
*Attorney, Agent, or Firm*—Thomas K. McBride; John F. Spears, Jr.; Reginald K. Taylor

[57] ABSTRACT

The present invention is an integrated catalytic reforming/hydrodealkylation process that maximizes benzene recovery by incorporating refrigeration and pressure swing adsorption separation units. In the refrigeration separation unit, liquid reformate is used as a sponge oil to recover benzene from a hydrodealkylation purge gas stream, which in the past has been vented. The pressure swing adsorption unit remove impurities from a hydrogen-rich gas stream prior to use in the hydrodealkylation unit.

11 Claims, 1 Drawing Sheet

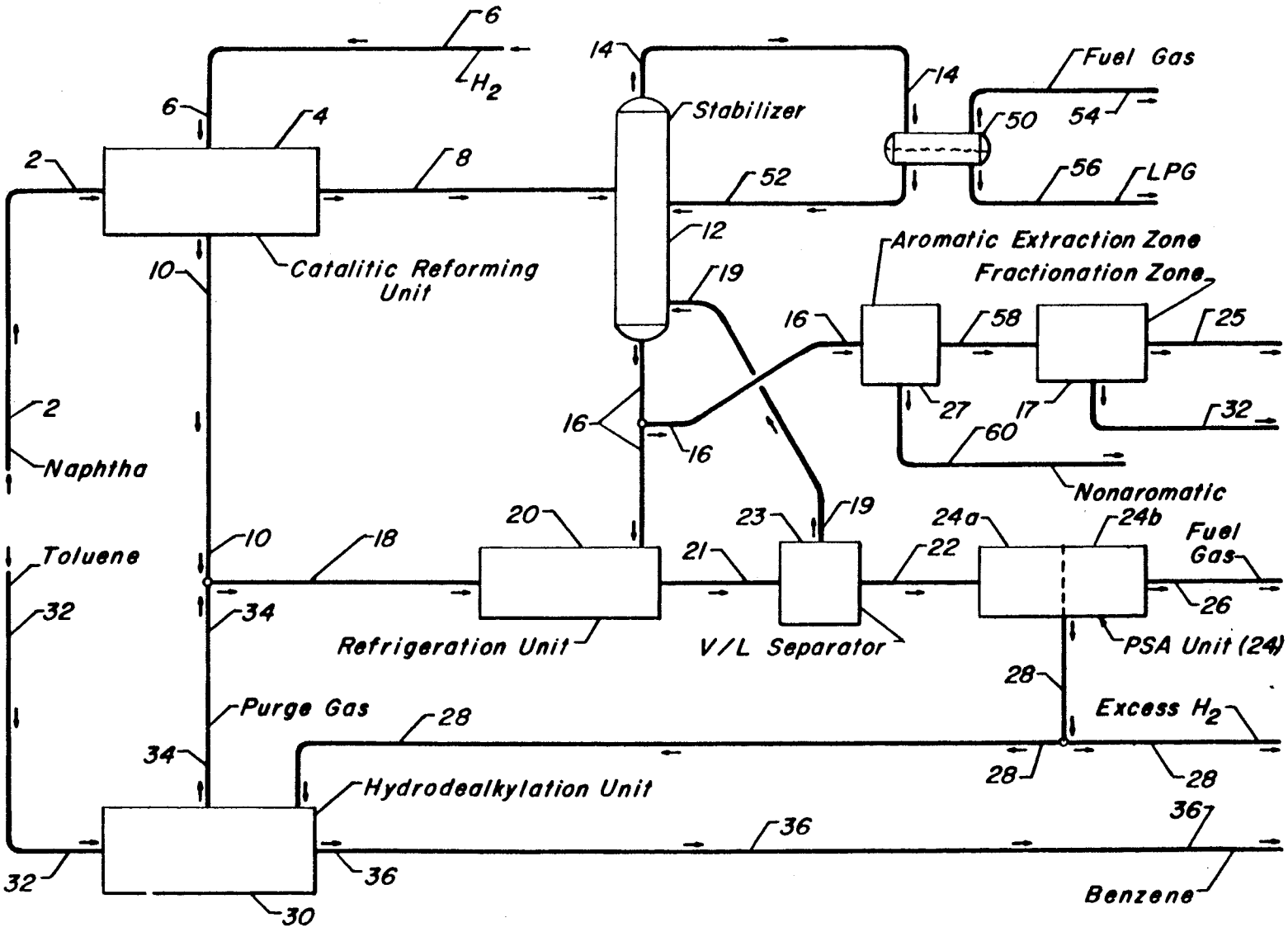
Fuel Gas
LPG
Stabilizer
Aromatic Extraction Zone
Fractionation Zone
Nonaromatic
Fuel Gas
PSA Unit (24)
Excess $H_2$
Benzene
V/L Separator
Refrigeration Unit
Hydrodealkylation Unit
Catalitic Reforming Unit
$H_2$
Purge Gas
Naphtha
Toluene

INTEGRATED CATALYTIC REFORMING AND HYDRODEALKYLATION PROCESS FOR MAXIMUM RECOVERY OF BENZENE

FIELD OF THE INVENTION

The present invention relates to an integrated catalytic reforming and hydrodealkylation process for maximum recovery of benzene and hydrogen. More specifically, the present invention involves the use of a process-derived catalytic reformate as a sponge oil in a refrigerated separation unit to recover hydrogen and benzene from a hydrodealkylation vent stream.

BACKGROUND OF THE INVENTION

Hydrocarbons classified as aromatics have enjoyed increasing demand in the marketplace due principally to their versatility as gasoline blending components. In addition, they can also be used as components in the production of various petrochemical compounds. This is particularly true in the case of benzene. Benzene represents the building block for the direct or indirect manufacture of well over 250 separate products or product classifications. Over the past few years, the annual benzene demand in the United States alone has ranged from 1.5 to 1.9 billion gallons. Worldwide, the annual consumption of benzene has ranged from 3.5 to 4.2 billion gallons. Historically, the major consumption of benzene has been in the production of ethylbenzene, cumene and cyclohexane. The principal use of ethylbenzene is to produce styrene by, for example, steam hydrogenation. Significant amounts of benzene are also consumed in the manufacture of aniline, detergent alkylate, and maleic anhydride.

At the present time, most of the total aromatics produced in the U.S. come from catalytic reforming of hydrocarbons. Typical reforming reactions include the dehydrogenation of naphthenes to produce aromatics, dehydrocyclization of paraffins directly to aromatics, the hydrocracking of long-chained paraffins into lower boiling, normally liquid material, and the isomerization of paraffins. In catalytic reforming of hydrocarbons, fresh liquid hydrocarbons boiling within the gasoline or naphtha boiling range are reacted with hydrogen in the presence of a catalyst comprising a Group VIII noble metal on a porous carrier at conditions which promote the conversion of naphthenes and paraffins to aromatic hydrocarbons.

Catalytic reforming is primarily an endothermic process effected in a plurality of reaction zones having interstage heating therebetween. The operation is effected primarily in vapor phase at temperatures of up to 1200° F. Other operating conditions include a pressure of about 20 to 1000 psig, a liquid hourly space velocity of about 0.2 to 10, and a hydrogen to hydrocarbon mole ratio of about 0.5:1 to 20:1.

The prior art is replete with catalytic reforming processes using a variety of schemes. For example, U.S. Pat. No. 3,664,949 (issued to Petersen et al.) discloses a process for reforming a petroleum hydrocarbon feedstock that boils within the range of about 120° to 500° F. and is selected from a group consisting of virgin naphthas, cracked naphthas, catalytic gasolines, coker naphthas, and mixtures thereof. In this process, the above-described feedstock is contacted in a reactor system consisting of two reactors in the presence of hydrogen and under reforming conditions with a catalyst in each reactor comprising a Group VIII noble metal and a co-catalytic solid support comprising mordenite. Another example of a catalytic reforming process can be found in U.S. Pat. No. 3,864,241 (issued to Rausch). The Rausch patent discloses a process for catalytically reforming a gasoline fraction comprising contacting the fraction with a catalytic composite comprising a combination of a platinum group component, a tin component, and a halogen component.

Processes that seek to maximize the production of benzene take at least a portion of the catalytic reformate containing alkylaromatics and react it in a dealkylation zone in the presence of hydrogen at conditions selected to dealkylate alkyl-substituted aromatic hydrocarbons. Thus, toluene and mixed xylenes are dealkylated for maximum benzene production, or toluene is transalkylated to maximize production of both benzene and mixed xylenes.

U.S. Pat. No. 3,197,523 is illustrative of a hydrodealkylation process. In this process, a feedstock comprising toluene, mixed xylenes, ethylbenzene, mixed diethylbenzenes, and various alkyl-substituted naphthalenes is reacted in the presence of a catalyst containing at least one oxide of tin, titanium, and zirconium combined with at least one oxide in chromium, molybdenum and tungsten at conditions including temperatures of about 1000° to 1500° F. and pressures of about 300 to 1000 psig.

U.S. Pat. No. 4,157,355 (issued to Addison) discloses an integrated catalytic reforming and hydrodealkylation process wherein a liquid phase of a catalytic reforming effluent is passed to a catalytic hydrodealkylation zone, the products of which are separated into a hydrogen-rich vapor phase and a liquid aromatic-containing phase. The hydrogen-rich vapor phase is then recycled to the catalytic reforming zone, and the aromatic-containing liquid phase is sent to a fractionator wherein a benzene-rich stream is recovered.

The prior art integrated processes have several disadvantages. First, in the prior art process, the hydrogen-rich gas contains some light hydrocarbons which are carried forward to the hydrodealkylation unit and which will crack to form methane in the hydrodealkylation unit, thereby increasing the overall hydrogen consumption. Second, in the prior art processes, a significant amount of benzene, hydrogen, and some methane can be lost through venting of purge gases in the hydrodealkylation unit. Third, the use of a catalytic hydrodealkylation unit has the disadvantage of process shutdowns required for catalyst replacement.

There is a need for an integrated catalytic reforming-/hydrodealkylation process that maximizes the recovery of benzene and uses hydrogen more efficiently.

SUMMARY OF THE INVENTION

In the present invention, the problem of introducing a relatively impure hydrogen make-up gas (hydrogen make-up gas being defined as the hydrogen gas produced in a hydrocarbon reforming process) into the hydrodealkylation unit is solved by first passing the hydrogen make-up gas through a refrigerated separation unit that uses a process-derived reformate as a sponge oil for:

(1) recovering benzene produced in the thermal dealkylation process of the present invention; and (2) recovering LPG material (which is defined as liquified petroleum gas products which are composed of those readily liquefiable hydrocarbon compounds which are produced in the course of conventional refining of crude oil) from the hydrogen make-up gas.

Accordingly, the benefits of the present invention include:

(1) increased benzene recovery;

(2) decreased hydrogen consumption in the thermal dealkylation zone due to reduced hydrocracking of paraffins that can enter the thermal dealkylation unit through the hydrogen make-up gas;

(3) increased LPG recovery due to a reduction in the amount of LP material sent to the thermal dealkylation zone where the LPG material can be cracked into lower value hydrocarbons; and (4) a smaller thermal dealkylation reactor due to a reduction in the amount of LPG material sent to the thermal dealkylation zone.

The present invention relates to a process for the recovery of benzene comprising the steps of: reacting a hydrocarbon charge stock and hydrogen in a catalytic reforming reaction zone at reforming conditions sufficient to produce a benzene-containing reformate and a hydrogen-containing vapor phase; passing the reformate into a stabilizing zone to produce a hydrocarbon-containing vapor phase and a benzene-containing, stabilized reformate, at least a portion of the benzene-containing, stabilized reformate being passed to a fractionation zone to produce a benzene-rich product stream and a toluene-rich stream; refrigerating the hydrogen-containing vapor phase and the benzene-containing, stabilized reformate and admixing the hydrogen-containing vapor phase with at least a portion of the benzene-containing, stabilized reformate to form a refrigerated admixture; introducing the refrigerated admixture to a vapor-liquid separator and withdrawing from the separator a hydrogen-rich gas stream comprising light hydrocarbons and a liquid phase stream; passing the hydrogen-rich gaseous stream to a first adsorber bed containing adsorbent having adsorptive capacity for hydrocarbons at effective adsorption conditions; withdrawing from the first adsorber bed a substantially hydrocarbon-free, hydrogen-rich gas stream; withdrawing a stream rich in hydrocarbons from a second adsorber bed containing adsorbent having adsorptive capacity for hydrocarbons, the bed undergoing desorption of previously loaded hydrocarbons and is undergoing desorption; reacting the toluene-rich stream, in admixture with at least a portion of the hydrocarbon-free, hydrogen-rich vapor phase, in a hydrodealkylation reaction zone at conditions selected to produce a benzene-containing product stream and a vapor-containing purge stream; and recovering the benzene-containing product stream.

In another embodiment, the present invention is a process for the recovery of benzene comprising the steps of: reacting a hydrocarbon charge stock and hydrogen in a catalytic reforming reaction zone at reforming conditions to produce a benzene-containing reformate and a hydrogen-containing vapor phase; passing the reformate into a stabilizing zone to produce a hydrocarbon-containing vapor phase and a benzene-containing, stabilized reformate, at least a portion of the benzene-containing, stabilized reformate being passed to a fractionation zone to produce a benzene-rich product stream and a toluene-rich stream: refrigerating the hydrogen-containing vapor phase and the benzene-containing, stabilized reformate and admixing the hydrogen-containing vapor phase with at least a portion of the benzene-containing, stabilized reformate to form a refrigerated admixture; introducing the refrigerated admixture to a vapor-liquid separator and withdrawing from the separator a hydrogen-rich gaseous stream comprising light hydrocarbons and a liquid phase stream, the liquid phase stream being recycled to the stabilizing zone; passing the hydrogen-rich gaseous stream to a first adsorber bed containing adsorbent having adsorptive capacity for hydrocarbons at effective adsorption conditions; withdrawing from the first adsorber bed a substantially hydrocarbon-free, hydrogen-rich gas stream; withdrawing a stream rich in hydrocarbons from a second adsorber bed containing adsorbent having adsorptive capacity for hydrocarbons, the bed undergoing desorption of previously loaded hydrocarbons; reacting the toluene-rich stream, in admixture with at least a portion of the hydrocarbon-free, hydrogen-rich vapor phase, in a hydrodealkylation reaction zone at conditions selected to produce a benzene-containing product stream and a vapor-containing purge stream; recycling the vapor-containing purge stream to the refrigeration section described hereinabove and admixing the vapor-containing purge stream with the benzene-containing, stabilized reformate; and recovering the benzene-containing product stream.

In another embodiment, the present invention is a process for the recovery of benzene comprising the steps of: reacting a hydrocarbon charge stock and hydrogen in a catalytic reforming reaction zone at reforming conditions to produce a benzene-containing reformate and a hydrogen-containing vapor phase; passing the reformate into a stabilizing zone to produce a hydrocarbon-containing vapor phase and a benzene-containing, stabilized reformate, at least a portion of the benzene-containing, stabilized reformate being passed to an aromatics extraction zone and a fractionation zone to produce a benzene-rich product stream and a toluene-rich stream; refrigerating the hydrogen-containing vapor phase and the benzene-containing, stabilized reformate at a temperature of less than about 40° F. and admixing the hydrogen-containing vapor phase with at least a portion of the benzene-containing, stabilized reformate to form a refrigerated admixture; introducing the refrigerated admixture to a vapor-liquid separator and withdrawing from the separator a hydrogen-rich gaseous stream comprising light hydrocarbons and a liquid phase stream, the liquid phase stream being recycled to the stabilizing zone; passing the hydrogen-rich gaseous stream to a first adsorber bed containing adsorbent having adsorptive capacity for hydrocarbons at effective adsorption conditions; withdrawing from the first adsorber bed a hydrocarbon-free, hydrogen-rich gas stream; withdrawing a stream rich in hydrocarbons from a second adsorber bed containing adsorbent having adsorptive capacity for hydrocarbons, the bed undergoing desorption of previously loaded hydrocarbons; reacting the toluene-rich stream, in admixture with at least a portion of the hydrocarbon-free, hydrogen-rich vapor phase, in a thermal hydrodealkylation reaction zone in the absence of an added catalyst at a temperature of at least about 1200° to 1500° F. to produce a benzene-containing product stream and a vapor-containing purge stream; recycling the vapor-containing purge stream to the refrigeration section described hereinabove and admixing the vapor-containing purge stream with the benzene-containing, stabilized reformate; and recovering the benzene-containing product stream.

BRIEF DESCRIPTION OF THE DRAWING

The figure is a schematic flowsheet of the process of the present invention.

BRIEF DESCRIPTION OF PREFERRED EMBODIMENT

The present invention is an integrated process that begins with catalytic reforming of hydrocarbons. Fresh feed charge stocks suitable for use in the present invention include liquid hydrocarbons boiling within the gasoline or naphtha boiling range, for example, hydrocarbons which exist in a liquid state at one atmosphere of pressure and a temperature of about 60° F., and which have normal boiling points up to about 425° F. Thus, it is contemplated that suitable charge stocks will include, but not by way of limitation, full boiling range naphthas (about 100° F. to about 400° F.), light naphthas (100° F. to 200° F.), and heavy naphthas (200° F. to about 400° F.) The naphtha feedstock may be preheated via indirect heat exchange with one or more high temperature process streams, such as process-derived reformate and dealkylation unit effluent. The naphtha feedstock may then be introduced into a direct fired heater wherein its temperature is further increased to the level needed to provide the design temperature at the inlet to the catalyst bed and the reforming reaction zone.

The catalytic reforming system may function with a plurality of fixed-bed zones, with a plurality of stacked zones through which catalyst particles flow via gravity, or a combination thereof.

The precise reforming operating conditions utilized in the reforming section of the present invention will depend on the chemical and physical characteristics of the naphtha boiling range charge stock as well as upon the selected aromatic concentrate. Nevertheless, operating conditions suitable for use in the present invention include temperatures in the range of about 750° to 1020° F., pressures in the range of about 20 to 1000 psig, a liquid hourly space velocity of about 0.5 to 10.0 (defined as volume of fresh charge stock per hour, per volume of total catalyst particles), and a hydrogen to hydrocarbon mole ratio in the range of about 1:1 to 15:1. As a practical matter, fixed bed reforming systems necessitate lower catalyst bed temperatures from 750° to 910° F., higher pressures from about 500 to 1000 psig, lower space velocities of about 0.5 to 2.5, and higher hydrogen to hydrocarbon mole ratios of 4.5:1 to about 8:1. On the other hand, benefits accrue through continuous catalyst regeneration reforming in that the operating conditions involve higher catalyst bed temperatures of about 950° to 1010° F., lower pressures of about 20 to 450 psig, higher space velocities of 3.0 to about 8.0, and lower hydrogen/hydrocarbon mole ratios of about 0.5:1 to 5.5:1.

A reforming catalyst suitable for use in the present invention includes, but is not limited to, any Group VIII noble metal deposited on a porous inorganic oxide support. Examples of Group VIII metals are platinum, palladium, rhodium, osmium, ruthenium, and iridium. Suitable inorganic oxides include, but are not limited to alumina, silica, zirconia, and any combinations thereof. In a preferred embodiment, cojoint catalyst modifiers can be used, such as, cobalt, nickel, gallium, germanium, tin, rhenium, vanadium, tungsten, zinc, and any mixtures thereof.

The products of the catalytic reforming unit are a benzene-containing reformate and a hydrogen-containing vapor phase. In addition to containing benzene, the benzene-containing reformate comprises other aromatics such as toluene and mixed xylenes. In addition to containing hydrogen, the hydrogen-containing vapor phase comprises light hydrocarbons, such as methane, ethane, propane, and butane. The benzene-containing reformate is sent to a stabilizing zone to produce a hydrocarbon-containing vapor phase comprising a substantial amount of the $C_1$–$C_2$ hydrocarbons and a benzene-containing stabilized reformate. The benzene-containing reformate also contains liquid $C_3$–$C_4$ hydrocarbons. Suitable operating conditions for the stabilizing zone include a pressure of about 100 to 300 psig and a bottoms temperature of 350° to 550° F.

In a preferred embodiment, at least a portion of the benzene-containing stabilized reformate is passed to an aromatics extraction zone. The purpose of the aromatic extraction zone is to separate benzene and other aromatics from nonaromatics that are not converted in the reforming zone. In the aromatic extraction zone, the aromatic-containing feed enters an extractor and flows upward countercurrently to a stream of lean solvent. As the feed flows through the extractor, aromatics are selectively dissolved in the solvent, and raffinate of very low aromatic content is withdrawn from the top of the extractor. Rich solvent from the extractor enters an extractive stripper in which partial stripping of the hydrocarbons from the rich solvent takes place. The nonaromatic components having volatilities higher than that of benzene under conditions existing in the column are essentially stripped from the solvent and removed in the overhead stream. This stream is returned to the extractor as recycle for recovery of aromatics contained therein, while facilitating purification by displacing heavy nonaromatics from the solvent phase by light easily stripped nonaromatic hydrocarbons contained in the recycle. The bottoms stream from the extractive stripper consists of solvent and aromatic components substantially free of nonaromatics. This stream enters the recovery column in which the aromatic product is separated from the solvent. Because of the large difference in boiling points between the solvent used and the heaviest desired aromatic product, this separation is handled readily. Lean solvent from the column is returned to the extractor. Raffinate from the extractor is contacted with water to remove dissolved solvent, and the rich water is returned to the extract-recovery column as stripping steam generated via exchange with the hot circulating solvent in a water-stripper reboiler.

In accordance with the present invention, at least a portion of the benzene-containing stabilized reformate is sent to a fractionation zone from which a benzene-rich product stream and a toluene-rich stream are produced.

An essential feature of the present invention is refrigerating the hydrogen-containing vapor phase to remove a substantial amount of any aromatics and LPG present therein prior to its use in the hydrodealkylation unit using a processed-derived, benzene-containing, stabilized reformate as the recovery liquid or sponge oil. Accordingly, in the present invention, the hydrogen-containing vapor phase is admixed with the benzene-containing, stabilized reformate to form an admixture which is subjected to refrigeration. The refrigeration lowers the temperature of the hydrogen-containing vapor phase and the benzene-containing stabilized reformate admixed therewith to a temperature of between −15° to 40° F.

After refrigeration, the resulting admixture is passed to a vapor-liquid equilibrium separation zone wherein there is produced a hydrogen-rich gas stream and liquid phase stream comprising recovered benzene, benzene-containing stabilized reformate, and LPG. This zone is operated at conditions that will maximize the absorption of the liquefiable hydrocarbons by the benzene-containing, stabilized reformate. Generally, the conditions within the separation zone will include a temperature of about −15° to 40° F. and a pressure of about 50 to 500 psig. The separation zone usually consists of an open vessel that operates in the nature of a flash drum.

The hydrogen-rich gas stream containing at least a portion of the benzene-containing, stabilized reformate is removed from the separator and passed to an adsorber bed containing adsorbent having adsorptive capacity for hydrocarbons at effective adsorption conditions. The adsorber bed is preferably part of an integrated pressure swing adsorption (PSA) process whereby a continuous adsorber operation can be maintained while simultaneously regenerating a spent adsorber bed.

It is contemplated that the PSA feature of the present invention comprises a plurality of adsorption zones maintained at an elevated pressure effective to adsorb hydrocarbons while letting the hydrogen pass through the adsorber bed. At a defined time, the passing of the adsorber feed to one adsorber bed is discontinued and the adsorber bed is depressurized by one or more co-current depressurization steps wherein the pressure is reduced to a defined level which permits additional hydrogen and light hydrocarbon components remaining in the adsorber bed to be withdrawn and utilized. Then the adsorber bed is depressured by a countercurrent depressurization step wherein the pressure in the adsorber bed is further reduced by withdrawing desorbed hydrocarbons countercurrently to the direction of the feed. Finally, the adsorber bed is purged and repressurized. A suitable purge gas is the co-current depressurization hydrogen-rich gas produced from another adsorber vessel. The final stage of repressurization is with feed gas or light gases produced during the adsorption step. An additional description of a pressure swing adsorption process suitable for use in the present invention can be found in U.S. Pat. No. 4,461,630 which is herein incorporated by reference.

The present invention can be performed using virtually any adsorbent material in the adsorber beds that has a preferential capacity for hydrocarbons as compared to hydrogen. Suitable adsorbents known in the art and commercially available include crystalline molecular sieves, activated carbons, activated clays, silica gels, activated aluminas and the like.

It is often desirable when using crystalline molecular sieves that the molecular sieve be agglomerated with a binder in order to ensure that the adsorbent will have suitable physical properties. Although there are a variety of synthetic and naturally-occurring binder materials available such as metal oxides, clays, silicas, aluminas, silica-aluminas, silica-zirconias, silica-thorias, silica-beryllias, silica-titanias, silica-alumina-thorias, silica-alumina-zirconias, mixtures thereof and the like, clay-type binders are preferred. Examples of binders which may be employed to agglomerate the molecular sieve without substantially altering the adsorptive properties of the zeolite are attapulgite, kaolin, volclay, sepiolite, polygorskite, kaolinite, bentonite, montmorillonite, illite, and chlorite. The choice of a suitable binder and methods employed to agglomerate the molecular sieves are generally known to those skilled in the art and need not be further described herein.

The PSA cycle used in the present invention preferably includes the steps of adsorption, at least one co-current depressurization step, countercurrent desorption, purge and repressurization. Thus, cycle steps are typically described with reference to their direction relative to the adsorption step. The cycle steps wherein the gas flow is in a concurrent direction to the adsorption step are known as "co-current" steps. Similarly, cycle steps wherein the gas flow is countercurrent to the adsorption step are known as "countercurrent" steps. During the adsorption step, the feed stream is passed to the adsorber bed at an elevated adsorption pressure in order to cause the adsorption of the hydrocarbons and produce a hydrocarbon-free, hydrogen-rich gas stream. During the co-current depressurization steps, the pressure in the depressurizing bed is released and the effluent obtained therefrom, which is rich in hydrogen, is passed in a countercurrent direction to another adsorber bed undergoing purge or repressurization. Typically, more than one co-current depressurization step is used wherein a first equalization step is performed after which a purge step is initiated wherein the adsorber bed is further co-currently depressured to provide a purge gas that is relatively impure with respect to the adsorbed component and thus is suitable for use as a purge gas. Optionally, a portion of hydrogen-rich adsorption effluent gas having a reduced concentration of hydrocarbons or an externally supplied gas can be used to supply the purge gas. Upon the completion of the co-current depressurization step, if employed, the adsorber bed is countercurrently depressurized to a desorption pressure in order to desorb the hydrocarbons. Upon completion of the desorption step, the adsorber bed is purged countercurrently with purge gas typically obtained from another bed. Finally, the adsorber bed is repressurized, first, typically with equalization gas from other adsorber beds and then with feed or product gas to adsorption pressure. Other additional steps known to those skilled in the art, such as a co-purge step wherein the adsorber bed is co-currently purged of the less strongly adsorbed components at an elevated pressure such as the adsorption pressure with a purge stream comprising hydrocarbons, can be employed.

The adsorber bed may suitably be operated at a pressure in the range of about 50 to 500 psig. The operating temperature for the adsorber bed can range from −20° to 150° F. These operating condition ranges are suitable for both adsorption and desorption. Additional adsorber bed operating conditions, such as cycle times and rates of depressurization, are not critical to the present invention and may readily be selected by a person skilled in the art.

In accordance with the present invention, a hydrocarbon-free, hydrogen-rich gas stream exits the PSA unit and is fed to a hydrodealkylation unit along with the previously mentioned toluene-rich stream. The hydrocarbon-free, hydrogen gas stream has a hydrogen purity of at least about 99 mol %. Accordingly, hydrocarbon-free is defined as a hydrocarbon content of less than about 1 mole % hydrocarbon, preferably less than about 0.1 mole % hydrocarbon, most preferably less than about 0.01 mole % hydrocarbon. In the hydrodealkylation unit, alkylaromatics contained in the toluene-rich stream are converted to benzene and light hydrocarbons (methane and ethane), while paraffins and naphthenes are hydrocracked. In a preferred embodiment, the hydrodealkylation unit is operated in the absence of an added catalyst, i.e., thermally.

Suitable hydrodealkylation operating conditions include a temperature of about 1000° to 2000° F., a pressure of about atmospheric to 1000 psig, preferably 50 to 750 psig. The make-up hydrogen rate to the dealkylation zone can be maintained slightly in excess of that required to dealkylate the alkyl aromatics.

Benzene is recovered from the hydrodealkylation unit by passing the hydrodealkylation effluent to a vapor-liquid equilibrium separator where the effluent separates into a liquid benzene product and a vapor-containing gas stream containing hydrogen, light hydrocarbons, and benzene. At least a portion of the vapor-containing gas stream is a purge stream while the remainder is recycled to the THDA reactor.

In a preferred embodiment, the vapor-containing purge stream is recycled back to the refrigerated separation unit where it is admixed with the previously-mentioned benzene-containing, stabilized reformate. In the refrigerated separation unit, the benzene contained in the vapor-containing purge stream is absorbed by the benzene-containing, stabilized reformate. A liquid phase containing the benzene-containing, stabilized reformate and benzene recovered from the vapor-containing purge stream exits the refrigerated separation unit and is recycled to the stabilizing zone. A hydrogen-rich gas stream containing the hydrogen and light hydrocarbons recovered from the vapor-containing purge stream exits the refrigerated separation unit and is passed on to the previously mentioned PSA unit where the hydrogen is separated from the light hydrocarbons in the manner previously described hereinabove.

Referring to the figure, a naphtha feedstock 2 is charged into a catalytic reforming unit 4 along with a hydrogen stream 6. This produces a benzene-containing reformate stream 8 and a hydrogen-containing vapor phase stream 10. The reformate stream 8 is then passed into a stabilizing zone 12 wherein there is produced a hydrocarbon-containing vapor phase stream 14 and a benzene-containing, stabilized reformate stream 16. The hydrocarbon-containing vapor phase stream 14 is directed to an overhead condenser 50. Exiting the top of the overhead condenser 50 is a fuel gas stream 54. Exiting the bottom of the overhead condenser 50 is a liquid reflux stream 52 and an LPG product stream 56. At least a portion of said benzene-containing, stabilized reformate stream 16 is first routed to an aromatic extraction zone 27 and then to a fractionation zone 17 to produce a benzene-rich product stream 25 and a toluene-rich stream 32.

The remainder of the benzene-containing, stabilized reformate 16 is directed to a refrigerated separation unit 20 where the benzene-containing, stabilized reformate 16 is refrigerated to a temperature of less than about 40° F. and admixed with said hydrogen-containing vapor phase 10. This refrigerated admixture 21 is then sent to a vapor-liquid separator 23 to produce a hydrogen-rich gas stream 22 and a liquid phase stream 19. This liquid phase stream 19 is recycled to the stabilizing zone 12.

The hydrogen-rich gas stream 22 is then directed to a pressure swing adsorption unit 24 having a first adsorber bed **24*a* and second adsorber bed 24*b*. The hydrogen-rich gas stream 22 is passed to the first adsorber bed 24*a* which contains adsorbent containing adsorptive capacity for hydrocarbons at effective adsorption conditions. A hydrocarbon-free, hydrogen-rich gas stream 28 is withdrawn from the first adsorber bed 24*a*. A stream rich in hydrocarbons 26 is withdrawn from the second adsorber bed containing adsorbent having adsorptive capacity for hydrocarbons, said second bed 24*b*** undergoing desorption of previously loaded hydrocarbons.

At least a portion of the hydrocarbon-free, hydrogen-rich ga stream 28 is then admixed with the toluene-rich stream 32 and reacted in a thermal hydrodealkylation unit 30 at conditions selected to produce a benzene-containing product stream 36 and a vapor-containing purge stream 34. The vapor-containing purge stream 34 containing benzene, hydrogen and light hydrocarbons generated in the hydrodealkylation unit 30 is then recycled to the refrigerated separation unit 20 where it is admixed with the benzene-containing, stabilized reformate 16.

What is claimed is:

1. A process for producing and recovering benzene from a naphtha charge stock comprising the steps of:

(a) reacting said hydrocarbon charge stock and hydrogen in a catalytic reforming reaction zone at reforming conditions to produce a benzene-containing reformate and a hydrogen-containing vapor phase;

(b) passing said reformate into a stabilizing zone to produce a hydrocarbon-containing vapor phase and a benzene-containing, stabilized reformate, passing at least a portion of said benzene-containing, stabilized reformate to a fractionation zone to produce a benzene-rich product stream and a toluene-rich stream;

(c) refrigerating said hydrogen-containing vapor phase and said benzene-containing, stabilized reformate and admixing said hydrogen-containing vapor phase with at least a portion of said benzene-containing, stabilized reformate to form a refrigerated admixture;

(d) introducing said refrigerated admixture to a vapor-liquid separator and withdrawing from said separator a hydrogen-rich gaseous stream comprising light hydrocarbons and a liquid phase stream;

(e) passing said hydrogen-rich gaseous stream to a first adsorber bed containing adsorbent having adsorptive capacity for hydrocarbons at effective adsorption conditions;

(f) withdrawing from said first adsorber bed a hydrocarbon-free, hydrogen-rich gas stream;

(g) withdrawing a stream rich in hydrocarbons from a second adsorber bed containing adsorbent having adsorptive capacity for hydrocarbons, said bed undergoing desorption of previously loaded hydrocarbons;

(h) reacting said toluene-rich stream, in admixture with at least a portion of said hydrocarbon-free, hydrogen-rich vapor phase, in a hydrodealkylation reaction zone at conditions selected to produce a benzene-containing stream and a vapor-containing purge stream; and (i) recovering said benzene-containing product stream.

2. The method of claim 1 wherein in step (c) said refrigeration occurs at a temperature of less than about 40° F.

3. The method of claim 1 further comprising recycling said liquid phase stream produced in step (d) to said stabilizing zone in step (b).

4. The method of claim 1 further comprising recycling said vapor-containing purge stream produced in step (h) to step (c) and admixing said vapor-containing purge stream with said benzene-containing, stabilized reformate.

5. The method of claim 1 wherein in step (h) said hydrodealkylation occurs in the absence of an added catalyst.

6. The method of claim 1 wherein said hydrodealkylation occurs at a temperature of about 1200° to 1500° F.

7. A process for producing and recovering benzene from a naphtha charge stock, comprising the steps of:

(a) reacting said hydrocarbon charge stock and hydrogen in a catalytic reforming reaction zone at reforming conditions to produce a benzene-containing reformate and a hydrogen-containing vapor phase;

(b) passing said reformate into a stabilizing zone to produce a hydrocarbon-containing vapor phase and a benzene-containing stabilized reformate, passing at least a portion of said benzene-containing, stabilized reformate to a fractionation zone to produce a benzene-rich product stream and a toluene-rich stream;

(c) refrigerating said hydrogen-containing vapor phase and said benzene-containing, stabilized reformate and admixing said hydrogen-containing vapor phase with at least a portion of said benzene-containing, stabilized reformate to form a refrigerated admixture;

(d) introducing said refrigerated admixture to a vapor-liquid separator and withdrawing from said separator a hydrogen-rich gaseous stream comprising light hydrocarbons and a liquid phase stream, recycling said liquid phase stream to said stabilizing zone in step (b);

(e) passing said hydrogen-rich gaseous stream to a first adsorber bed containing adsorbent having adsorptive capacity for hydrocarbons at effective adsorption conditions;

(f) withdrawing from said first adsorber bed a hydrocarbon-free, hydrogen-rich gas stream;

(g) withdrawing a stream rich in hydrocarbons from a second adsorber bed containing adsorbent having adsorptive capacity for hydrocarbons, said bed undergoing desorption of previously loaded hydrocarbons;

(h) reacting said toluene-rich stream, in admixture with at least a portion of said hydrocarbon-free, hydrogen-rich vapor phase, in a hydrodealkylation reaction zone at conditions selected to produce a benzene-containing product stream and a vapor-containing purge stream;

(i) recycling said vapor-containing purge stream to step (c) and admixing said vapor-containing purge stream with said benzene-containing, stabilized reformate; and (j) recovering said benzene-containing product stream.

8. The method of claim 7 wherein the step (c) said refrigeration occurs at a temperature of less than about 40° F.

9. The method of claim 7 wherein the step (h) said hydrodealkylation occurs in the absence of an added catalyst.

10. The method of claim 1 wherein said hydrodealkylation occurs at a temperature of about 1200° to 1500° F.

11. A process for producing and recovering benzene from a naphtha charge stock comprising the steps of:

(a) reacting said hydrocarbon charge stock and hydrogen in catalytic reforming reaction zone at reforming conditions to produce a benzene-containing reformate and a hydrogen-containing vapor phase;

(b) passing said reformate into a stabilizing zone to produce a hydrocarbon-containing vapor phase and a benzene-containing, stabilized reformate, passing at least a portion of said benzene-containing, stabilized reformate to an aromatic extraction zone and a fractionation zone to produce a benzene-rich product stream and a toluene-rich stream;

(c) refrigerating said hydrogen-containing vapor phase and said benzene-containing, stabilized reformate at a temperature of less than about 40° F. and admixing said hydrogen-containing vapor phase with at least a portion of said benzene-containing, stabilized reformate to form a refrigerated admixture;

(d) introducing said refrigerated admixture to a vapor-liquid separator and withdrawing from said separator a hydrogen-rich gaseous stream comprising a light hydrocarbons and a liquid phase stream, recycling said liquid phase stream to said stabilizing zone in step (b);

(e) passing said hydrogen-rich gaseous stream to a first adsorber bed containing adsorbent having adsorptive capacity for hydrocarbons at effective adsorption conditions;

(f) withdrawing from said first adsorber bed a hydrocarbon-free, hydrogen-rich gas stream;

(g) withdrawing a stream rich in hydrocarbons from a second adsorber bed containing adsorbent having adsorptive capacity for hydrocarbons, said bed undergoing desorption of previously loaded hydrocarbons;

(h) reacting said toluene-rich stream, in admixture with at least a portion of said hydrocarbon-free, hydrogen-rich vapor phase, in a thermal hydrodealkylation reaction zone in the absence of an added catalyst at a temperature of at about 1200° to 1500° F. to produce a benzene-containing product stream and a vapor-containing purge stream;

(i) recycling said vapor-containing purge stream to step (c) and admixing said vapor-containing purge stream with said benzene-containing, stabilized reformate; and (j) recovering said benzene-containing product stream.

* * * * *